US007910848B2

(12) United States Patent
Thuersam et al.

(10) Patent No.: US 7,910,848 B2
(45) Date of Patent: Mar. 22, 2011

(54) EASY-TO-CLEAN KEYPAD DEVICE

(75) Inventors: Markus Thuersam, Weil Der Stadt (DE); Wilhelm Weissgerber, Puchheim (DE); Joachim Kwasny, Munich (DE); Falk Herrmann, Oberhaching (DE); Sonja Tiedemann, Riemerling (DE); Peter Theunissen, Beilstein (DE)

(73) Assignee: Robert Bosch GmbH, Stuttgart (DE)

( * ) Notice: Subject to any disclaimer, the term of this patent is extended or adjusted under 35 U.S.C. 154(b) by 348 days.

(21) Appl. No.: 11/865,107

(22) Filed: Oct. 1, 2007

(65) Prior Publication Data

US 2008/0237017 A1 Oct. 2, 2008

(30) Foreign Application Priority Data

Oct. 5, 2006 (DE) ..... 10 2006 047 590

(51) Int. Cl.
*H01H 13/06* (2006.01)

(52) U.S. Cl. ..... 200/302.2; 200/306

(58) Field of Classification Search ..... 200/302.2, 200/302.3, 339, 345, 306
See application file for complete search history.

(56) References Cited

U.S. PATENT DOCUMENTS 3,941,953 A * 3/1976 Misson et al. ..... 200/5 R
4,468,542 A * 8/1984 Pounds ..... 200/5 A
5,389,755 A * 2/1995 Chen ..... 200/341
5,612,692 A * 3/1997 Dugas et al. ..... 341/22
5,729,222 A 3/1998 Iggulden et al.
5,794,762 A 8/1998 Tsai
6,049,048 A * 4/2000 Ohira ..... 200/339
7,456,369 B2 * 11/2008 Watanabe ..... 200/341

FOREIGN PATENT DOCUMENTS

DE 297 04 273 4/1997
DE 103 08 204 2/2004
EP 0 841 673 5/1998

* cited by examiner

*Primary Examiner* — Renee Luebke
*Assistant Examiner* — Lheiren Mae A Caroc
(74) *Attorney, Agent, or Firm* — Michael J. Striker

(57) ABSTRACT

Keypad devices have become commonplace in everyday life. They are part of our everyday life, in the form of pocket calculators, telephones, remote control devices, and cellular phones. Cleaning these keypad devices is problematic, since they have a large number of actuatable keys, due to the functions to be performed. As a mechanical interface in the keypad device, each key is a critical weak point in terms of maintaining a tight seal. An easy-to-clean keypad device, in particular an emergency call device, has a main body, an electronic assembly—which includes circuit elements and is installed in main body—a closing shell and keys, which are installed in closing shell and are designed to mechanically actuate the circuit elements. Closing shell with installed keys is a first preinstalled assembly, and main body with installed electronic assembly is a second preinstalled assembly. The first and second preinstalled assemblies are interconnected such that they may be separated.

11 Claims, 4 Drawing Sheets

EASY-TO-CLEAN KEYPAD DEVICE

CROSS-REFERENCE TO A RELATED APPLICATION

The invention described and claimed hereinbelow is also described in German Patent Application DE 102006047590.9 filed on Oct. 5, 2006. This German Patent Application, whose subject matter is incorporated here by reference, provides the basis for a claim of priority of invention under 35 U.S.C. 119(a)-(d).

BACKGROUND OF THE INVENTION

The present invention relates to an easy-to-clean keypad device, an emergency call device in particular, with a main body, an electronic assembly—which includes the circuit elements and is installed in the main body—a closing shell and keys, which are installed in the closing shell and are designed to mechanically actuate the circuit elements.

Keypad devices have become commonplace in everyday life. They are part of our everyday life, in the form of pocket calculators, telephones, remote control devices, and cellular phones. It is a problem when these keypad devices become dirty, because they have a large number of actuatable keys, due to the functions to be performed. As a mechanical interface in the keypad device, each key is a critical weak point in terms of maintaining a tight seal.

To prevent permanent damage to the keypad devices caused by contamination, the weak points are typically sealed using suitable means, or the keypad device is brought to a special facility for cleaning if it becomes dirty.

SUMMARY OF THE INVENTION

Accordingly, it is an object of the present invention to provide an easy-to-clean keypad device, which is a further improvement of the existing devices of this type.

In keeping with these objects and with others which will become apparent hereinafter, one feature of the present invention resides, briefly stated, in a keypad device, comprising a main body; an electronic assembly including circuit elements and installed in said main body; a closing shell; a plurality of keys which are installed in said closing shell and configured to mechanically actuate said circuit elements, said closing shell with said installed keys together forming a first preinstalled assembly, while said main body with said electronic assembly forms a second preinstalled assembly, said first and second assemblies being interconnected such that they are separable.

The present invention provides a keypad device that includes at least two assemblies. The first assembly is designed as a main body with an electronic assembly installed directly or indirectly in the main body. The main body is preferably designed as a base shell.

Receptacles, for example, for rubber feet or the like are located on the outside of the main body, and/or openings for cables are provided. Plastic is used preferably as the material for the main body, which is preferably designed as two pieces. The electronic assembly contains the electronic and/or electrical components—or at least a portion thereof—required to operate the keypad device, and it includes several circuit elements, which are realized, e.g., in the form of keys or pressure-sensitive sensors.

The second assembly is designed as a closing shell, which preferably forms a cover for the first assembly and/or the base shell. The second assembly also includes a plurality of keys, all of which, in particular, are installed in or on the closing shell, and which—in the installed state of the keypad device—are designed and/or located for mechanical actuation of the switching elements. The closing shell is also preferably designed as a single piece and/or is made of plastic.

According to the present invention, the first and second assembly are designed such that they may be separated from each other, i.e., during disassembly, the first assembly in the preinstalled state, i.e., with the electronic assembly installed, is separated from the second assembly in the preinstalled state, i.e., with the keys installed, and it is separated entirely, in particular.

The advantage of the inventive device is that, due to the distribution of functionality between the first and second components that is provided, the keypad device may be disassembled and cleaned easily if it becomes dirty. To do this—and without needing to visit a special facility—the second assembly, which is designed as the upper piece, is removed from the first assembly, which is designed as the lower piece, in order to be cleaned.

In a preferred design of the keypad device, it is designed as an emergency call device, which operates either via radio communication or via cable. The emergency call device preferably includes fewer than 10 keys. In particular, 2, 4 or 8 keys are used, which are assigned or are assignable, e.g., with preprogrammed functions, such as emergency call, accepting incoming calls, stopping a pre-alarm, initiating a direct (service) call, calling up a device status, confirming measured data, resetting a security clock or logging the user and/or caregiver on or off. In particular, the emergency call device includes an interface for bidirectional communication with a telephone and/or a control station management system, via which data related to the emergency call may be exchanged.

The first preinstalled assembly is therefore designed, in particular, as an assembly free of electrical and/or electronic components, i.e., it is exclusively mechanical in nature. This design underscores the inventive thought, that the first assembly may be cleaned easily, in particular without complications caused by electrical components. The disassembled first assembly, as the mechanical assembly, may be cleaned easily, e.g., with water.

In a preferred embodiment of the keypad device, the first assembly includes one or more fastening devices, which are designed to detachably install the keys in the closing shell. The fastening devices are preferably designed as snap-in connections, so that the keys may be snapped or clipped into the closing shell. This design makes it possible, in a first step, to separate the first assembly from the second assembly, and, in a second, optional step, to reversibly remove the keys from the closing shell, thereby enabling the keys to be cleaned individually. The fastening device is preferably designed such that the keys do not fall out, even when the first assembly has been removed. The direction in which the keys are removed is oriented in the direction of their actuation, so that, when the first assembly is installed, the keys may not be accidentally pressed out, since they strike an end stop in the second assembly.

To prevent the keys from being mixed up or turned around when they are reinstalled after disassembly, the fastening device(s) include(s) coding means. The coding means may be used in particular when the keys may be mixed up, because they have similar or identical outer dimensions, i.e., diameters in particular.

In an advantageous design, the fastening device is designed as a guide bolt on the key side, and as snap-in receptacles on the closing-shell side for receiving the guide bolts. The guide bolts are preferably oriented perpendicularly or nearly perpendicularly to the actuating direction of the keys. Particularly cost-favorable fabrication is attained when the guide bolt(s) are formed as one piece and/or are installed on the assigned key, and/or the snap-in receptacles are formed as one piece and/or are installed in the closing shell. The snap-in receptacles associated with a key are preferably integrally formed as receiving openings in a ring—which encloses the related key in the manner of a circle—as an open, oblong slot with a taper on the inlet side.

Preferably, at least two guide bolts—which are positioned on the key asymmetrically relative to each other—are assigned to each key. The lines defined by the longitudinal extension of the guide bolts are positioned at an angle to each other, skewed, and/or displaced vertically, thereby preventing the guide bolts from being located at the same height, diametrically, and/or opposite to each other. In particular, when keys otherwise have the same design or could be mixed up, the relative positions of the at least two guide bolts are designed specifically for a key, e.g., the intermediate angles between the two guide bolts are chosen to be different from key to key.

The designs described have the advantage that the keys may only be inserted in the closing shell with the correct position and orientation. The guide bolts and the snap-in receptacles thereby perform two functions, i.e., as secure fastening means and as coding means.

In a preferred embodiment of the present invention, the electronic assembly is designed as a circuit board, which is mounted directly or indirectly, e.g., via a chassis, on the base shell. A key mat is installed between the circuit board and the keys, which, however, in accordance with the inventive thought, is located such that it is insulated in a form-fit or bonded manner relative to the keys and/or closing shell. The key mat is one piece of the circuit elements of the electronic assembly.

In a refinement of the keypad device, every key includes several—up to four, in particular—actuating feet for actuating several—up to four, in particular—circuit elements. In an embodiment in which the number of actuating feet is equal to the number of circuit elements, a redundant switch system is created, which remains functional even if one of the circuit elements should fail, e.g., due to contamination. An embodiment in which the number of actuating feet is less than the number of circuit elements makes it possible, however, to utilize various functions of the keypad device, depending on the design of the key used. Depending on the circuit pattern of the actuating feet, and/or depending on the circuit elements actuated, e.g., various functions stored in the keypad device via programming or circuitry are activated.

The circuit pattern defines the geometric layout of the actuated circuit elements, that is, e.g., diagonal, in a row, in a column, in the shape of an "L", in the shape of a rotated "L", selected corner points, etc. The fact that the keypad device is disassembled and assembled easily makes it easier to replace one of the keys, to reprogram the keypad device, i.e., to assign a new function to a selected key position. In particular, a set of replacement keys and a selection of different replacement functions are provided in the keypad device. The replacement functions may be activated by installing the assigned replacement key. The keypad device is therefore easy to clean and easy to service.

In an advantageous embodiment of the present invention, design-related measures have been implemented to prevent the interior of the keypad device from becoming dirty. These measures are realized as discharge and/or drainage channels, which are designed to direct any fluid that may have penetrated the interior next to the keys out of the housing. The discharge and/or drainage channels are preferably formed via the interaction of the first and second assemblies. Optionally, the main body is designed as a base shell with a chassis mounted thereon, the electronics assembly being installed on the chassis.

The keys include a circumferential collar, which engages via its free end in a channel system or labyrinth of the chassis, so that fluid running off of the collar is directed into the channel system or labyrinth and, from there, is directed to a drainage outlet opening, via a slanted surface, in particular.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
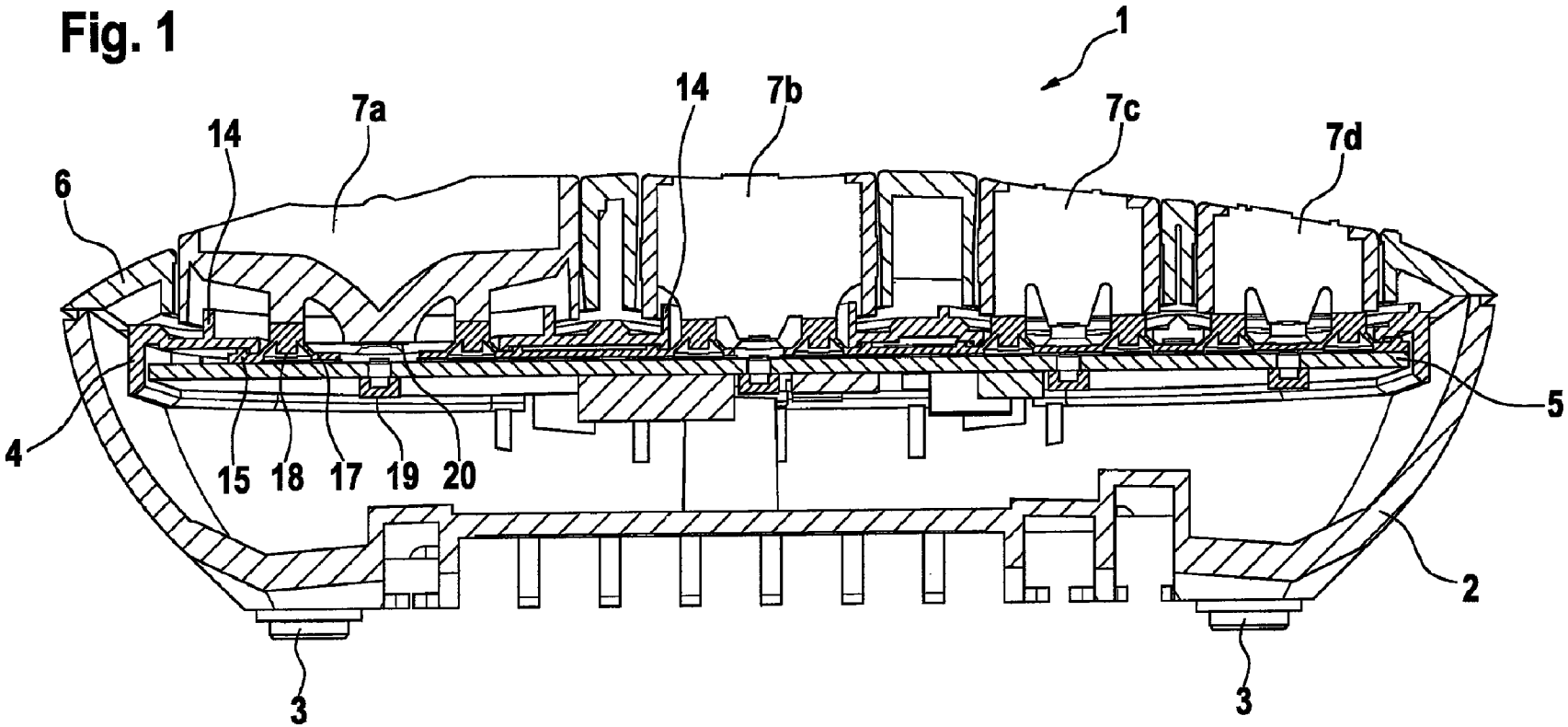
FIG. 1 shows a preferred exemplary embodiment of the present invention in the form of an emergency call device, in a cross-sectional illustration.

In the easy-to-clean keypad device in accordance with the present invention, parts or dimensions which are identical in the figures are labeled with the same reference numerals. For clarity, the components referred to in the description are usually labeled with reference numerals only once, even when the components appear in a figure more than once.

FIG. 1 shows a first exemplary embodiment of the present invention that is designed as an emergency call device 1, in a cross-sectional, three-dimensional illustration from the front.

The lower piece of emergency call device 1 is formed by a base shell 2, which includes receptacles for base feet 3 on the underside, to ensure that emergency call device 1 may be placed securely on a support surface. Base shell 2 is formed, e.g., as a first injection-moulded piece. A chassis 4 is mounted on base shell 2, e.g., via a snap-in connection, and base shell 2 encloses chassis 4 in a retaining manner. Chassis 4 may also be designed as an injection-moulded piece, and it is oriented parallel or substantially parallel to the support surface in its two-dimensional extension. A circuit board 5, which is oriented parallel or substantially parallel to chassis 4 in its two-dimensional extension, is mounted on underside of chassis 4, which faces the support surface.

Emergency call device 1, is closed on its top side via an upper shell or closing cover 6, which may also be designed as an injection-moulded piece, and on which four keys 7*a, b, c* and *d* are installed. Upper shell 6 and keys 7*a, b, c* form a first assembly, which, in the preinstalled state, may be removed entirely from the second, preinstalled assembly, which is formed by base shell 2, chassis 4, and circuit board 5. When emergency call device 1 is disassembled, it is separated into the two assemblies. In particular, the installation of keys 7*a, b, c* and *d* is designed such that they do not fall out even when upper shell 6 is removed. Since the first assembly is designed as a purely mechanical assembly, it may be cleaned easily after disassembly.

By separating the function carrier of the second assembly, chassis 4 in particular, and design element chassis 6 with keys 7*a, b, c* and *d*, the appearance may also be easily changed. The number of keys may be changed easily via this separation by using a replacement upper shell with fewer than four receptacles for keys. In addition, the color and geometry of the upper shell may be changed as requested by the customer or for a specific application, without needing to intervene in the base device, i.e., the second assembly.

Figure 2:
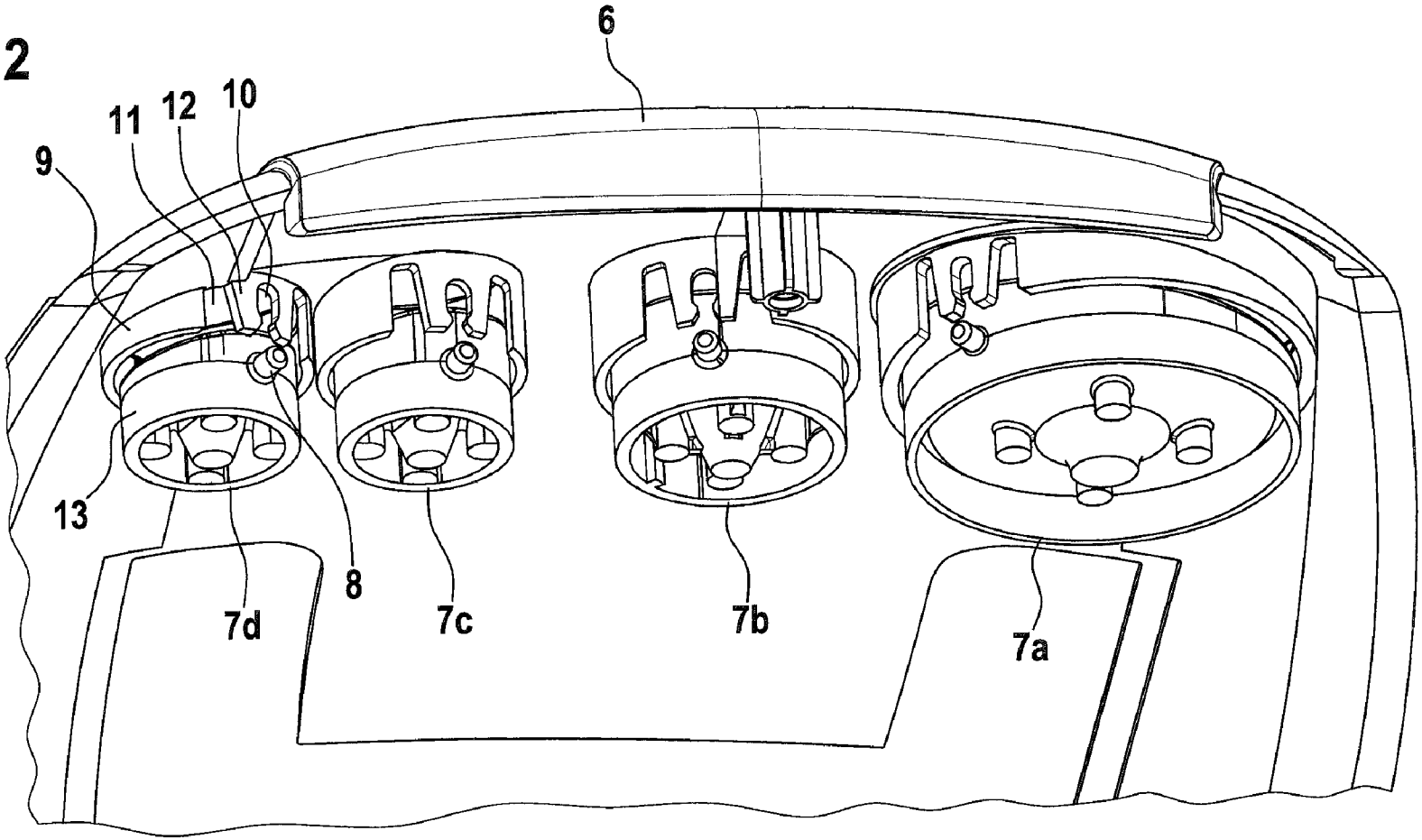
FIG. 2 shows a detailed sectional view of the emergency call device in the region of the closing cover, as viewed from the interior of the housing, in a schematicized, three-dimensional illustration.

As shown in FIG. 2, which shows upper shell 6 and keys 7*a, b, c* and *d* in a schematicized, three-dimensional exploded view from the inside of the housing, keys 7*a, b, c* and *d* are snapped into upper shell 6 from below, i.e., from the interior of the housing, against the actuating direction. Keys 7*a, b, c* and *d* include four guide bolts 8 for this purpose, which are integrally formed on keys 7*a, b, c* and *d* such that they extend perpendicularly to the actuating direction. To receive guide bolts 8, guide bushings 9 are integrally formed in upper shell 6, which guide keys 7*a, b, c* and *d* in the actuating direction.

Oblong slots 10, which are open toward the interior of the housing and are tapered in the inlet section, are formed in guide bushings 9. Gaps 11 in guide bushings 9 are formed on either side of slots 10. Slots 10 are therefore formed by freestanding blades 12 located between gaps 11 and slots 10. When keys 7*a, b, c* and *d* are installed, guide bolts 8 are snapped into assigned slots 10 by bending freestanding blades 12 elastically apart while inserting guide bolt 8. After keys 7*a, b, c* and *d* are snapped in place, they are captively held, and they may move freely along oblong slots 10 in the actuation direction of keys 7*a, b, c* and *d*.

Figure 3:
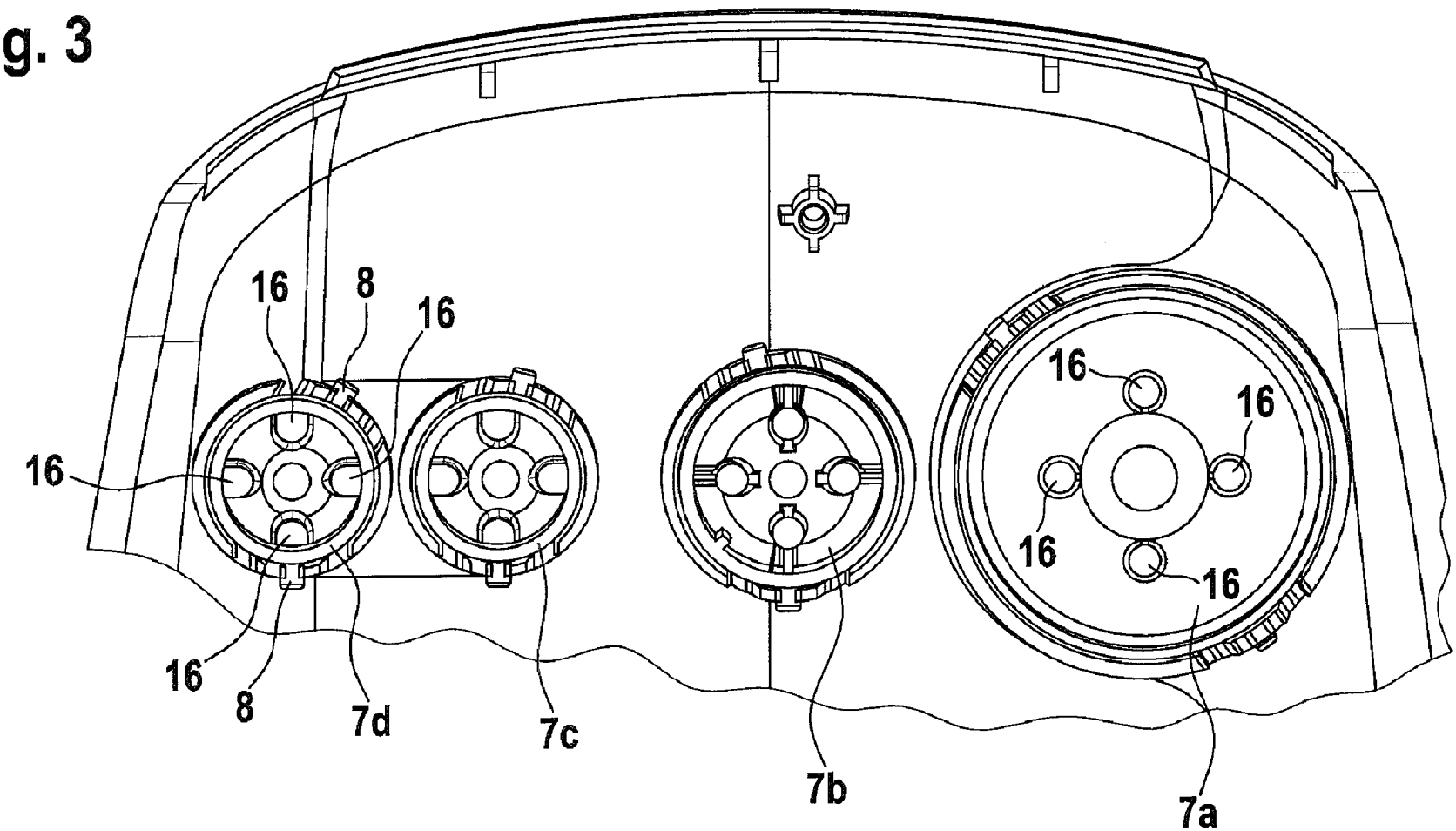
FIG. 3 essentially shows the detailed sectional view in FIG. 2 from a different viewing angle.

As shown in the top view in FIG. 3, from the inside of the housing toward the same region as shown in FIG. 2, each of the keys 7*a, b, c* and *d* includes two guide bolts 8, which may be inserted in related slot 10. Optionally, more guide bolts 8 may be provided for each key 7*a, b, c*, and *d*. Guide bolts 8 are not located opposite to each other. They form an intermediate angle that is not 180°. This design ensures that the correct installation position—not upside-down, in particular—is attained during initial assembly and during reassembly after cleaning. With keys having the same or a similar diameter, the intermediate angle between the guide bolts is different, to ensure that a key is not installed in the wrong position.

As shown best in FIG. 1, keys 7*a, b, c*, and *d* each include a circumferential, annular segment 13 on the free end extending into the housing. When keys 7*a, b, c*, and *d* are installed, segment 13 is located parallel to guide bushing 9. Each segment 13 encloses an annular sealing collar 14 integrally formed with chassis 4. Even in the non-actuated state of keys 7*a, b, c* and *d*, segment 13 and sealing collar 14 are located such that they overlap in the axial direction, i.e., in the direction of actuation of keys 7*a, b, c* and *d*. Segment 13 serves to carry away—in a controlled manner—any fluid that may have entered keypad formed by keys 7*a, b, c* and *d*. This fluid may be directed via segments 13 to chassis 4. Sealing collars 14 ensure that the fluid may not reach circuit board 5, which is located underneath chassis 4. Instead, the fluid is diverted to the side via the shape of chassis 4, e.g., via discharge channels. As further protection against fluid or the like that may enter, circuit board 5 is located under chassis 4, where it is protected.

As is also shown best in FIG. 1, a key mat 15 is installed between keys 7*a, b, c* and *d* and circuit board 5. Key mat 15 extends over entire circuit board 5 or at least over the region of the circuit elements of circuit board 5 and is fixed in position or clamped between circuit board 5 and chassis 4 via an enclosing section of chassis 4. If keys 7*a, b, c* and *d* are actuated, key mat 15 is compressed or deformed, which directly actuates the circuit elements, which are formed by key mat 15 and circuit board 5. To transfer the compression forces, every key 7*a, b, c* and *d* includes four compression punches 16, which are located inside segment 13 (see FIGS. 2 and 3). Compression punches 16 are located on transfer bridges 17 of key mat 15.

Transfer bridges 17 are deformed elastically when pressure is applied, and they come in contact via a contact tip or a carbon tip 18 with contact fields (not shown) located on circuit board 5, thereby resulting in electrical contact being established. In a modified embodiment, only two of the four compression punches 16 serve to transmit a switching impulse, and the remaining two compression punches 16 are used to stabilize keys 7*a, b, c* and *d*. In another exemplary embodiment, different, replaceable keys are used. The keys differ according to the number or design of compression punches 16, thereby enabling a different selection of circuit elements to be actuated. Depending on the selection of circuit elements, different programmed functions of emergency call device 1 are activated. The possible functions of emergency call device 1 may therefore be changed easily by replacing a current key with a replacement key, which, e.g., actuates a pressure point on the key mat and, therefore, another circuit pattern on circuit board 5, thereby triggering a different function.

Illumination means, LEDs 19 in this example, are located in the center on the underside of circuit board 5, underneath particular key 7*a, b, c* and *d*, the illumination means being designed to illuminate keys 7*a-d*. The illumination takes place through an opening in circuit board 5 and chassis 4, so that an end section 20—which is flat or concavely curved, in particular—of keys 7*a, b, c* and *d* is illuminated. The light passes through flat end section 20 and is guided via light guidance through particular key 7*a, b, c* and *d* to the center or edge section of key 7*a*, b, c and d, which is visible to the user, thereby illuminating it and making it easier to see in dark surroundings.

Figure 4B:
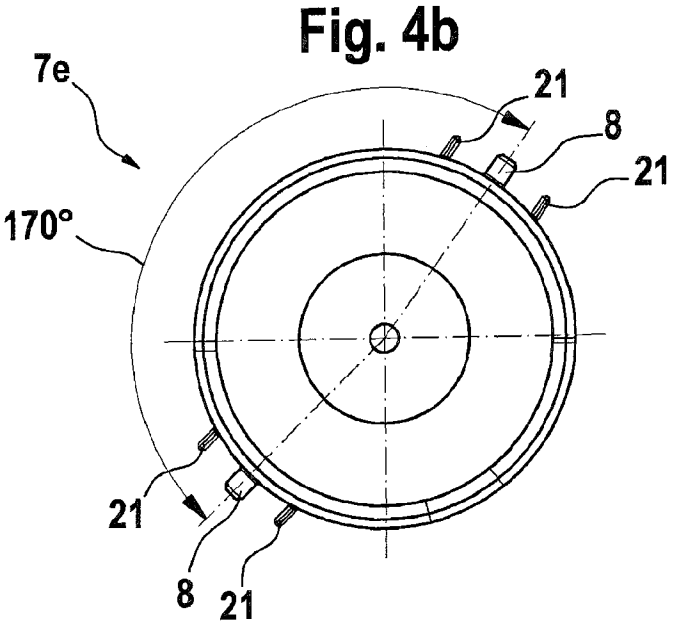
FIGS. 4*a-d* show a top view, an underside view, and cross-sectional views, in a schematic illustration, of one possible embodiment of a key for the emergency call device in FIGS. 1 through 3.
Figure 4D:
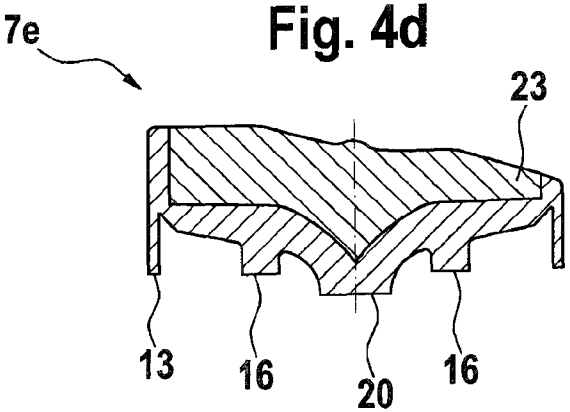
Figure 4A:
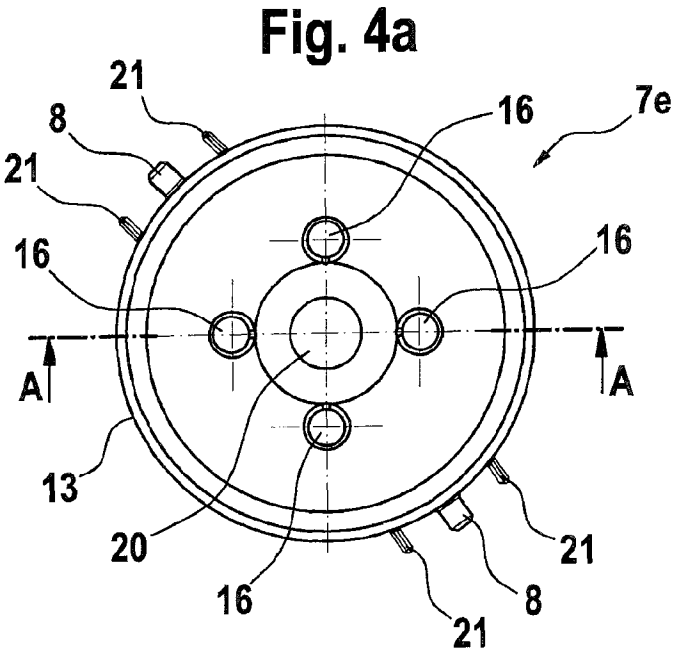

FIGS. 4*a* through *d* show an exemplary embodiment of a key 7*e* of the type that may be used in the device shown in FIGS. 1 through 3. FIG. 4*a* shows key 7*e* in a top view from below, so that the circular basic cross section is easy to see. Flat end section 20 is located in center, and it is surrounded by four compression punches 16, which are distributed evenly azimuthally. Annular segment 13 is also shown. It encloses end section 20 and compression punch 16. Two guide bolts 8 are integrally formed such that they extend radially outwardly or protrude. In their cross section that is perpendicular to their longitudinal extension, guide bolts 8 are circular or elliptical in shape. In addition, two guide segments 21 may be integrally moulded in place parallel to guide bolts 8, and which engage in bilateral gaps 11 in the installed state.

As shown in FIG. 4*b*, which shows keys 7*e* in a top view from above, the two guide bolts 8 are not located diametrical to each other, but rather form an intermediate angle of 170°. This intermediate angle ensures that key 7*e* may not be installed upside-down. In addition, keys with the same outer diameter may be coded mechanically via the intermediate angle to prevent incorrect installation, at the wrong insertion point in particular.

Figure 4C:
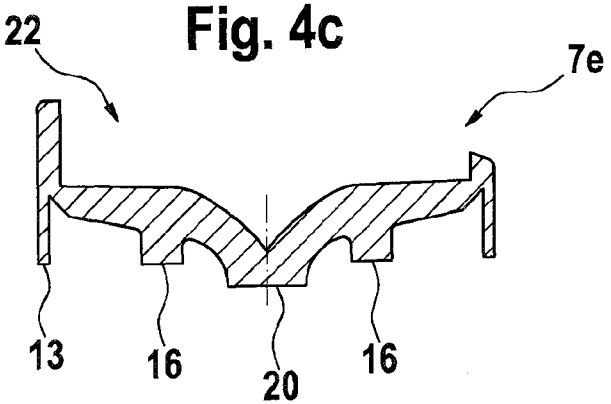

FIG. 4*c* shows key 7*e* in a schematic cross-sectional drawing along a line of intersection A-A in FIG. 4*a*. It is clear that the upper side of key 7*e* forms a receptacle for an actuating element 23, which is shown inserted in FIG. 4*d*. Key 7*e* is composed of a hard material, e.g., polycarbonate. Actuating element 23 is injected, bonded, or mechanically snapped into receptacle 22, and it is also formed of a hard material, e.g., polycarbonate or ABS, to impart a positive tactile impression to the user. A symbol or the like may be provided on the upper side of actuating element 23. To transmit the light emitted by the LEDs, the material of which key 7*e* is made is translucent or transparent, and it may be optionally colored, e.g., red, blue or yellow.

The surfaces of key 7*e* are polished, to minimize the interfacial losses of the light. Actuating element 23 is opaque, so that the edge region of key 7*e* is illuminated in this embodiment. In an alternative embodiment, an opaque key includes a central opening, into which a transparent or translucent actuating element is injected, bonded, or snapped in place mechanically. The actuating element includes an end section, so that the light from LEDs 19 is guided through the actuating element. In an alternative embodiment, the center of the key is therefore illuminated.

It will be understood that each of the elements described above, or two or more together, may also find a useful application in other types of constructions differing from the type described above.

While the invention has been illustrated and described as embodied in an easy-to-clean keypad device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A keypad device, comprising a main body;

an electronic assembly including circuit elements and installed in said main body;

a closing shell;

a plurality of keys which are installed in said closing shell and configured to mechanically actuate said circuit elements, said closing shell with said installed keys together forming a first preinstalled assembly, while said main body with said electronic assembly forms a second preinstalled assembly, said first and second assemblies being interconnected such that they are separable; and a fastening device which is configured as a guide bolt on a key side and as a snap-in receptacle comprising guide bushings integrally formed on an upper portion of a closing-shell side and having a peripheral wall with a portion having an aperture which receives said guide bolt, which guide bolt is configured to be oriented outwardly away from an axial center and in a direction selected from a group consisting of perpendicularly and substantially perpendicularly with respect to an actuating direction of said keys in order to detachably install said keys in said closing shell, wherein at least one of said keys includes at least two guide bolts arranged in a manner selected from a consisting of positioned on said at least one key asymmetrically relative to each other, configured to have an intermediate angle of less than or greater than 180° , and both.

2. A keypad device as defined in claim 1, wherein said first assembly is configured as a mechanical assembly which is free of electrical and electronic components.

3. A keypad device as defined in claim 1, wherein said fastening device for detachably installing said keys in said closing shell is configured as a snap-in device.

4. A keypad device as defined in claim 1, wherein said fastening device includes coding means for ensuring proper installation and/or arrangement of said keys.

5. A keypad device as defined in claim 1, wherein said at least two guide bolts are arranged so that said intermediate angles of said guide bolts of individual ones of said keys are different.

6. A keypad device as defined in claim 1, wherein said electronic assembly is configured as a circuit board with a key mat which is installed between said circuit board and said keys, and is arranged in a manner selected from the a consisting of located, installed, and both, such that it is insulated in a manner selected from a consisting of a form-fit manner and bonded manner relative to an element selected from the group consisting of said keys, said closing shell, and both.

7. A keypad device as defined in claim 1, wherein said keys are configured to actuate one of up to four of said circuit elements of said electronic assembly, said electronic assembly being configured such as to perform different functions depending on a parameter selected from a group consisting of a number, a selection, and both of said circuit elements that were actuated.

8. A keypad device as defined in claim 1, wherein said main body includes a base shell and a chassis mounted on said base shell, said electronic assembly being configured as a circuit board mounted on said chassis, said chassis comprising a collar, and wherein said keys and said collar together with said chassis form a drainage system configured to carry away any fluid entering between said keys and said closing shell.

9. A keypad device as defined in claim 1, wherein the keypad device is configured as an emergency call device.

10. A keypad device as defined in claim 1, wherein said snap-in receptacle is oblong.

11. A keypad device, comprising a main body;

an electronic assembly including circuit elements and installed in said main body;

a closing shell;

a plurality of keys which are installed in said closing shell and configured to mechanically actuate said circuit elements, said closing shell with said installed keys together forming a first preinstalled assembly, while said main body with said electronic assembly forms a second preinstalled assembly, said first and second assemblies being interconnected such that they are separable; and a fastening device which is configured as a guide bolt on a key side and as a snap-in receptacle on a closing-shell side for receiving said guide bolt, which guide bolt is configured to be oriented in a direction selected from a group consisting of perpendicularly and substantially perpendicularly with respect to an actuating direction of said keys in order to detachably install said keys in said closing shell, wherein at least one of said keys includes at least two guide bolts arranged in a manner selected from a group consisting of positioned on said at least one key asymmetrically relative to each other, configured to have an intermediate angle of less than or greater than 180° , and both, and so that said intermediate angles of said guide bolts of individual ones of said keys are different.

* * * * *